US006435897B1

(12) United States Patent
Paul et al.

(10) Patent No.: US 6,435,897 B1
(45) Date of Patent: Aug. 20, 2002

(54) COMPACT PCI CONNECTOR GUIDE

(75) Inventors: Dieter Paul, Anaheim; James Yuhan, Laguna Hills, both of CA (US)

(73) Assignee: StorCase Technology, Inc., Fountain Valley, CA (US)

( * ) Notice: Subject to any disclaimer, the term of this patent is extended or adjusted under 35 U.S.C. 154(b) by 0 days.

(21) Appl. No.: 09/546,368

(22) Filed: Apr. 10, 2000

(51) Int. Cl.[7] ..... H01R 13/64
(52) U.S. Cl. ..... 439/374; 439/701; 439/567
(58) Field of Search ..... 439/374, 701, 439/377, 680, 65, 59, 62, 567

(56) References Cited

U.S. PATENT DOCUMENTS 3,651,444 A * 3/1972 Desso et al. ..... 439/42
3,966,290 A * 6/1976 Little et al. ..... 339/17
4,352,536 A * 10/1982 Goldberg ..... 439/75 MP
4,445,740 A * 5/1984 Wallace ..... 439/45 M
4,448,471 A * 5/1984 Berry et al. ..... 439/91 R
4,996,478 A * 2/1991 Pope ..... 324/158 P
5,030,141 A * 7/1991 Winstein et al. ..... 439/680
5,147,225 A * 9/1992 Kile et al. ..... 439/680
5,161,996 A * 11/1992 Locati ..... 439/374
5,475,568 A * 12/1995 Umesato ..... 361/374
5,697,805 A * 12/1997 Orstad et al. ..... 439/374
5,718,597 A * 2/1998 Kodama ..... 439/374
5,785,536 A * 7/1998 McCartin et al. ..... 439/78
5,928,024 A * 7/1999 Ming-Huang ..... 439/377
5,934,926 A * 8/1999 Gabrisko, Jr. et al. ..... 439/364
6,010,373 A * 1/2000 Donahue ..... 439/717
6,102,747 A * 8/2000 Paagman ..... 439/701
6,171,125 B1 * 1/2001 Kirkendall ..... 439/218
6,203,380 B1 * 3/2001 Harting et al. ..... 439/680

* cited by examiner

*Primary Examiner*—Tho D. Ta
*Assistant Examiner*—Phuongchi Nguyen
(74) *Attorney, Agent, or Firm*—Morland C. Fischer

(57) ABSTRACT

A compact PCI connector guide to be attached to a motherboard of a small computer system to surround a male PCI connector that is affixed to the motherboard. The PCI connector guide is adapted to accurately and automatically guide an incoming female PCI connector that is carried on a detachable peripheral printed circuit board into mating engagement with the male PCI connector, whereby the motherboard and the peripheral board are electrically interconnected with one another. The PCI connector guide has a body and flared lips projecting outwardly therefrom to automatically redirect the female PCI connector towards and into receipt by the male PCI connector without subjecting the contact pins of the male PCI connector to damage as a consequence of the male and female PCI connectors being misaligned with one another.

3 Claims, 3 Drawing Sheets

COMPACT PCI CONNECTOR GUIDE

BACKGROUND OF THE INVENTION

1. Field of the Invention

This invention relates to a compact PCI (peripheral component interconnect) connector guide that is attached to a motherboard of a small computer system to surround a male PCI connector in order to automatically and blindly direct an incoming female PCI connector that is carried on a detachable peripheral printed circuit board into a relatively quick and reliable mating engagement with the male PCI connector, whereby one or more electrical components on the peripheral board are interconnected with electrical components of the motherboard.

2. Background Art

In the small computer industry, it is sometimes necessary to detachably interconnect one or more electrical components that are carried on a peripheral printed circuit board with the electrical components and a bus system on a motherboard. That is to say, different peripheral boards are capable of performing different functions, such that it may become necessary to detachably connect a particular peripheral board to the motherboard at a certain time to perform a certain small computer function. When the computer function has been completed, the peripheral board is removed from the motherboard to wait further use.

The detachable peripheral circuit board typically has one or more female PCI connectors which must be mated to respective male PCI connectors that are affixed to the motherboard. A rapid and careless attachment of the female connectors to the male connectors has been known to cause an incomplete interconnection of the peripheral board to the motherboard and/or possible damage to the exposed contact pins of the male PCI connector. Otherwise, time and effort must be spent to properly align the incoming female and stationary male PCI connectors one above the other to assure the straight-in attachment of the female contacts to corresponding ones of the male contact pins.

Therefore, what is needed is a compact and inexpensive means for quickly, automatically and accurately guiding the male and female PCI connectors into mating engagement with one another so that the peripheral board can be reliably interconnected with the motherboard without damaging pins of the male PCI connector.

SUMMARY OF THE INVENTION

In general terms, disclosed below is a compact PCI connector guide to be attached to the motherboard of a small computer system to surround a male PCI connector that is affixed to the motherboard in order to accurately and automatically direct an incoming female PCI connector that is carried on a detachable printed circuit board into a quick and reliable mating engagement with the male PCI connector. The PCI connector guide includes front, back and opposite side walls to define a hollow interior within which to receive the male PCI connector when the connector guide is attached to the motherboard. A flared lip projects outwardly from each of the front, back and side walls of the connector guide so as to extend above the male PCI connector.

The PCI connector guide is attached to the motherboard by means of a pair of slotted locking posts that are located through holes in the motherboard. The locking posts depend downwardly from respective tabs that project from the opposite side walls of the connector guide. Each of the flared lips projecting from the opposite side walls of the connector guide has a locating notch formed therein to receive respective leading edge portions of the peripheral board. The locating notches are positioned closer to either the front or back wall of the connector guide. This off-center position of the locating notches in the flared lips assures a unidirectional insertion of the incoming female connector into the PCI connector guide and towards the stationary male PCI connector affixed to the motherboard.

The flared lips of the PCI connector guide facilitate a relatively. quick and accurate blind mating of the female and male PCI connectors by automatically redirecting the female PCI connector towards the contact pins of the male PCI connector to establish a complete electrical connection therebetween without subjecting the contact pins to possible damage. What is more, the PCI connector guide avoids the time and accuracy necessary in conventional small computer interconnect systems by eliminating the requirement that the male and female PCI connectors to be aligned one above the other to facilitate a straight-in connection.

DETAILED DESCRIPTION

Figure 1:
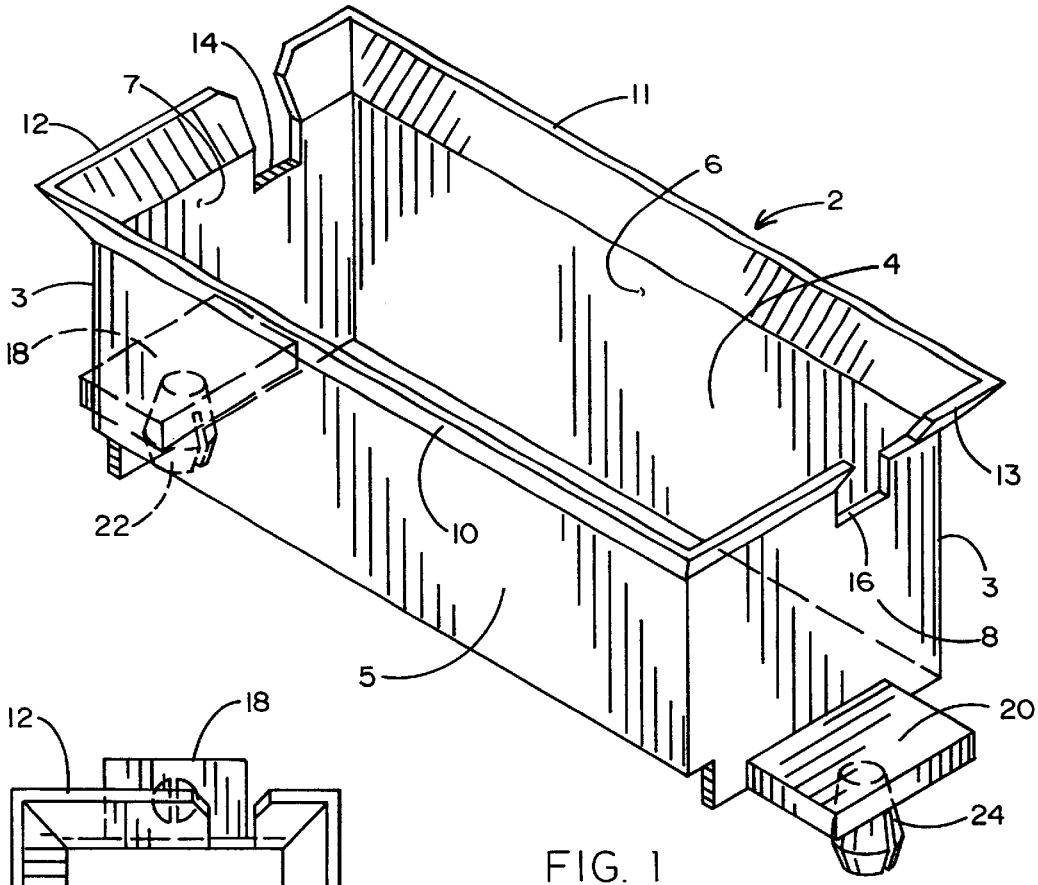
FIG. 1 shows a perspective view of the compact PCI connector guide which forms the present invention.

The compact PCI (peripheral component interconnect) connector guide 2 which forms the present invention is now disclosed while referring to the drawings. As will be described in greater detail hereinafter, the connector guide 2 has a configuration which is particularly sized and adapted to permit the blind mating of a female PCI connector (designated 52 and best shown FIGS. 6–9) carried on a detachable peripheral printed circuit board 50 to a male PCI connector 62 that is electrically connected to a main motherboard 60 and surrounded by connector guide 2.

The female PCI connector 52 having a plurality of recessed contacts (not shown) and the male PCI connector 62 having a plurality of elongated contact pins (designated 64 in FIG. 8) are conventional devices and will not be described further herein. Moreover, the peripheral circuit board 50 on which the female PCI connector 52 is carried contains commercially available electronic components and circuits to perform one or more small computer functions in combination with the components and circuits of motherboard 60. For example, the peripheral circuit board 50 may contain a repeater chip, such as that disclosed in pending patent application Ser. No. 09/332,015 filed Jun. 14, 1999. To this end, an interconnection of the female and male PCI connectors 52 and 62 causes the aforementioned repeater chip on peripheral circuit board 50 to be electrically connected to an external cable of the motherboard 60.

Figure 2:
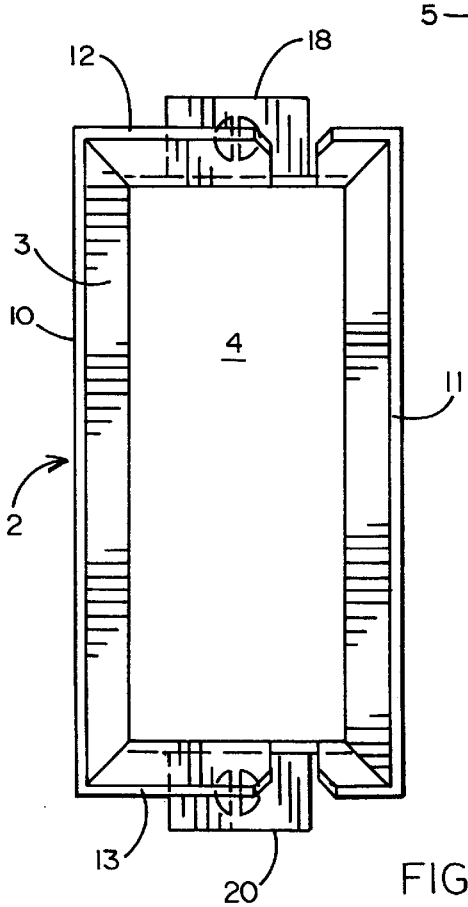
FIG. 2 is a top view of the PCI connector guide of FIG. 1.
Figure 3:
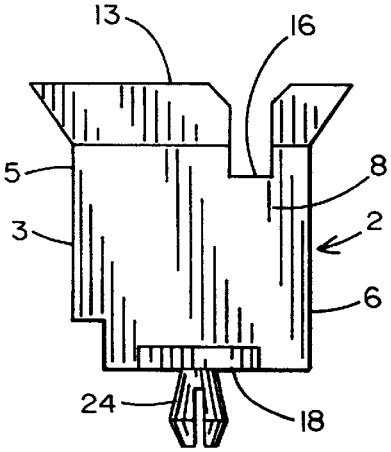
FIG. 3 is a side view of the PCI connector guide of FIG. 1.

Turning initially to FIGS. 1–3 of the drawings, the PCI connector guide 2 includes a rectangular body 3 having a hollow interior 4 that is defined by front, back and opposite side walls 5, 6, 7 and 8. Projecting upwardly from each wall 5–8 of the body 3 of connector guide 2 is an outwardly flared lip 10, 11, 12 and 13. As an important advantage of this invention, the outwardly flared lips 10–13 of connector body 3 function to guide the incoming female PCI connector 52 from peripheral circuit board 50 into a reliable mating engagement with the stationary male PCI connector 62 that is affixed to motherboard 60. By virtue of the foregoing, the requirement in conventional interconnect systems for a straight-in connection of the recessed contacts of the female PCI connector to the contact pins of the male PCI connector is advantageously avoided. In this regard, any offset or misalignment in the conventional interconnect systems between the male and female contacts could result in bent contact pins, an incomplete electrical connection, or no connection at all.

In the case of the present invention, the outwardly flared lips 10–13 from the body 3 of the PCI connector guide 2 compensate for any misalignment between the recessed contacts of the incoming female PCI connector 52 with the contact pins 64 of the stationary male PCI connector 62. Thus, and as is best shown in FIGS. 6–9, the flared lips 10–13 of connector guide 2 facilitate a relatively quick and accurate blind mating of the female and male PCI connectors 52 and 62 by automatically redirecting the female PCI connector 52 towards the contact pins 64 of male PCI connector 62 to establish a complete electrical connection therebetween without subjecting the contact pins 64 to possible damage.

Figure 8:
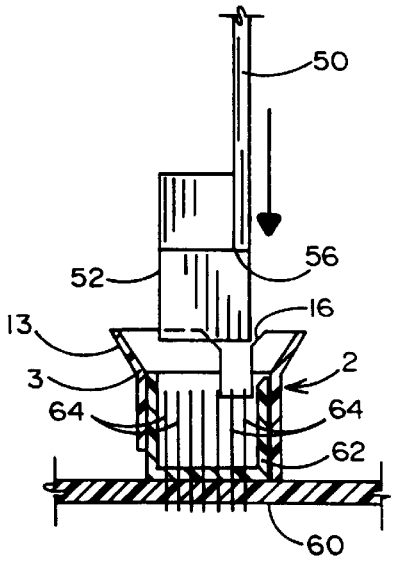
FIGS. 8 and 9 illustrate the PCI connector guide automatically directing the incoming female PCI connector carried on the peripheral circuit board into mating engagement with the contact pins of the male PCI connector affixed to the motherboard.

A locating notch 14 and 16 is cut into each of the flared lips 12 and 13 which depend from the opposite side walls 7 and 8 of the body 3 of PCI connector guide 2. It is desirable that the locating notches 14 and 16 be positioned closer to one or the other of the front and back walls 5 or 6 of the connector body 3. The locating notches 14 and 16 are sized to receive respective portions (designated 54 and 56 in FIG. 6) of the leading edge of the peripheral circuit board 50 on which the incoming female connector 52 is carried. As is best shown in FIGS. 8 and 9, the off-center position of the locating notches 14 and 16 in the flared lips 12 and 13 assures a unidirectional insertion of the incoming female connector 52 into the PCI connector guide 2 and towards the stationary male PCI connector 62.

Figure 9:
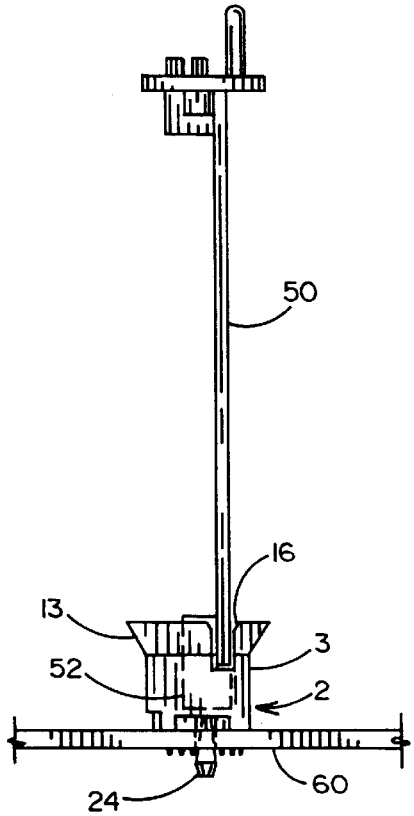
Figure 6:
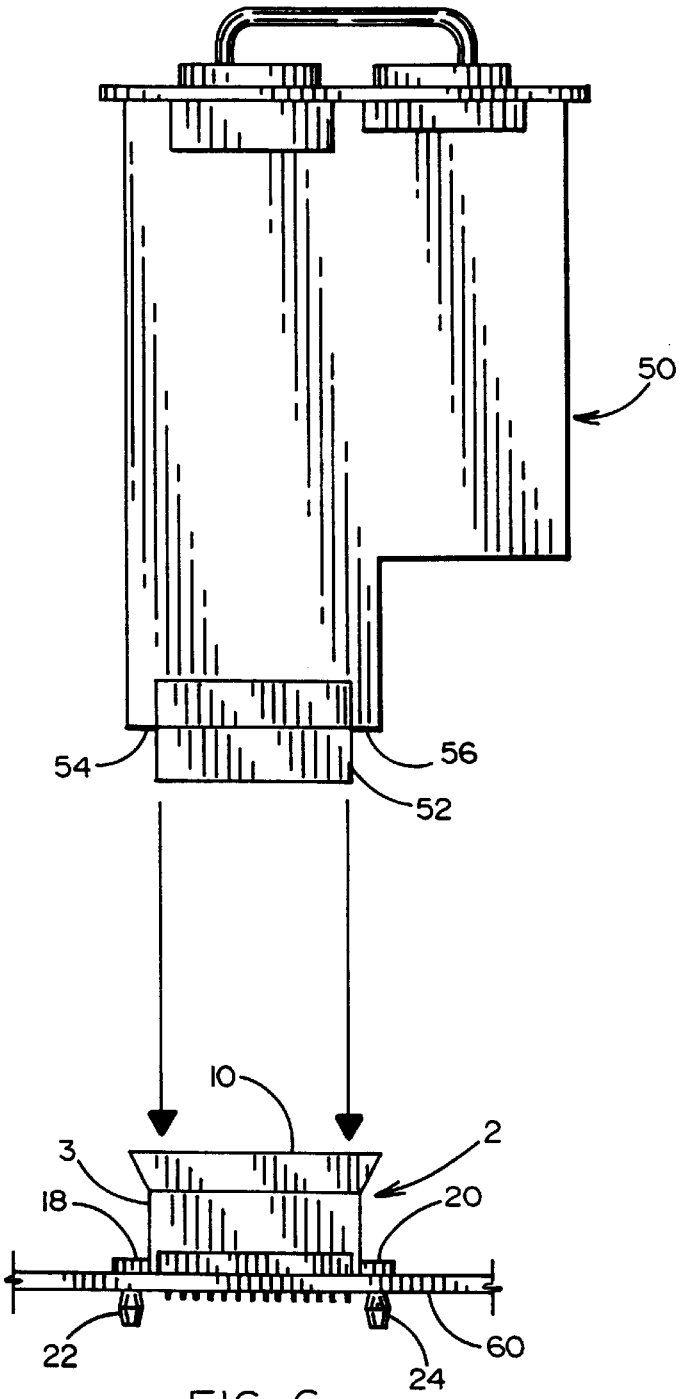
FIGS. 6 and 7 illustrate a female PCI connector carried on a peripheral circuit board moving towards mating engagement with the male PCI connector affixed to the motherboard and surrounded by the PCI connector guide of this invention.
Figure 7:
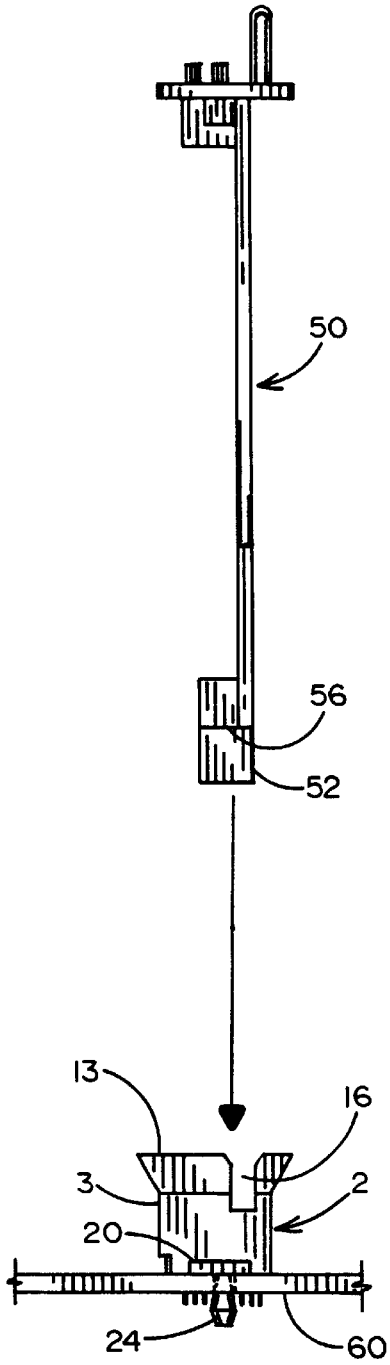

More particularly, the incoming female connector 52 must be inserted within the connector guide 2 so that the portions 54 and 56 along the leading edge of peripheral circuit board 50 (of FIG. 6) will be received by the locating notches 14 and 16 (best shown in FIG. 9). In the event that the incoming female connector 52 were to be inserted backwards (i.e. opposite the direction shown in FIG. 9), then the leading edge portions 54 and 56 of peripheral circuit board 50 would impact against the flared lips 12 and 13 which depend from side wall 7 and 8, whereby to block the insertion of incoming female connector 52 through PCI connector guide 2 and prevent the electrical connection of the female and male PCI connectors 52 and 62 to one another.

Figure 4:
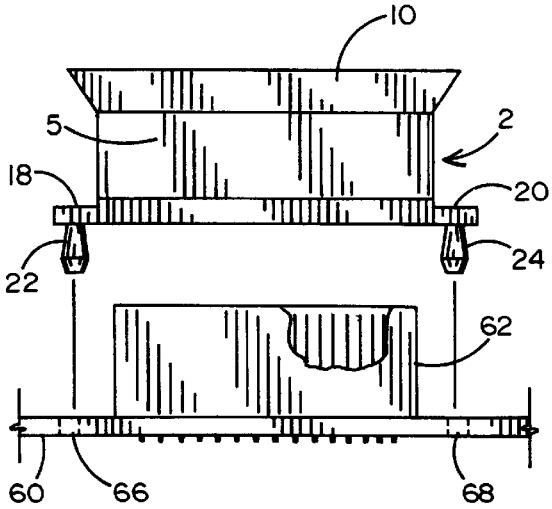
FIG. 4 illustrates the attachment of the PCI connector guide of this invention to a motherboard so as to surround a male PCI connector affixed thereto.

Projecting outwardly from the side walls 7 and 8 of the body 3 of PCI connector guide 2 are tabs 18 and 20. A slotted locking post 22 and 24 depends downwardly from each tab 18 and 20 so as to be located through a corresponding hole (designated 66 and 68 and best shown in FIG. 4) in the motherboard 60 to which connector guide 2 is to be attached. Therefore, in the interconnect configuration of FIGS. 6–9, the PCI connector guide 2 will be fastened to and the tabs 18 and 20 thereof are seated upon motherboard 60 when the locking posts 22 and 24 are pushed downwardly through respective holes 66 and 68 in the motherboard. Because of their slotted nature, the locking posts 22 and 24, which are compressed to a reduced size as they are pushed through the holes 66 and 68, expand to their original size at the underside of motherboard 60 so as to prevent the connector guide 2 from being inadvertently detached from the motherboard.

Figure 5:
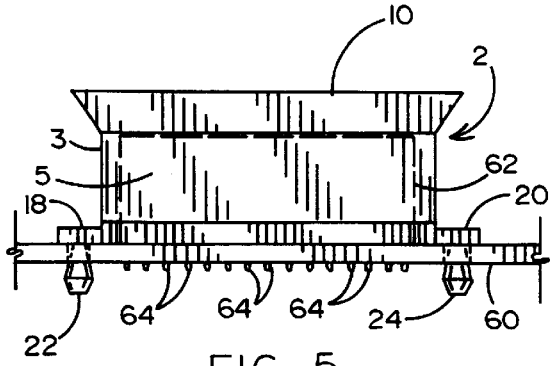
FIG. 5 shows the PCI connector guide attached to the motherboard and surrounding the male PCI connector.

As is best shown in FIG. 5 of the drawings, the PCI connector guide 2 is attached to motherboard 60 (by means of locking posts 22 and 24) in order to surround the stationary male PCI connector 62 that is electrically connected to motherboard 60. The outwardly flared lips 10–13 of connector body 3 extend above the male PCI connector 62 so as to receive thereagainst and automatically guide incoming female PCI connector 52 carried on the peripheral circuit board 50 into detachable mating engagement with the contact pins 64 of the male PCI connector 62 in the manner that has been described above with regard to FIGS. 6-9, but without requiring the time or accuracy necessary in conventional small computer interconnect systems to first align the connectors 52 and 62 directly above one another to facilitate a straight-in connection. This advantage may be particularly useful in the event that a plurality of female PCI connectors carried on a peripheral circuit board are to be mated to a respective plurality of male PCI connectors that are affixed to a motherboard.

Although it has been described above for an incoming female PCI connector to be carried on the peripheral circuit board 50 to be mated to a stationary male connector on the motherboard 60, it is to be understood that the location of the male and female connectors can be reversed. In other words, the male PCI connector may be carried on the peripheral circuit board 50 to be moved through the PCI connector guide 2 and into mating engagement with the female PCI connector that is electrically connected to the motherboard 60.

We claim:

1. In combination:

a first printed circuit board;

a first electrical connector affixed to said first printed circuit board; and a connector guide for aligning a second electrical connector for movement into mating engagement with said first electrical connector on said first printed circuit board to establish an electrical connection therebetween, said connector guide having a body that is sized to surround said first electrical connector, at least one locking post depending from said body by which said connector guide is detachably connected to said first printed circuit board and removable from said printed circuit board independently of said first electrical connector, and a plurality of flared lips projecting outwardly from and above said body for engaging the second electrical connector and automatically guiding the second electrical connector into mating engagement with said first electrical connector.

2. The combination recited in claim 1, including a second printed circuit board to which the second electrical connector is affixed, at least one of said outwardly flared lips projecting from the body of said connector guide having a locating notch formed therein in which to receive said second printed circuit board when the second electrical connector on said second printed circuit board is guided into mating engagement with the first electrical connector on said first printed circuit board.

3. The combination recited in claim 2, wherein said locating notch is positioned off-center in said at least one outwardly flared lip projecting from the body of said connector guide, such that said locating notch is positioned closer to one side of said body than to an opposite side.

* * * * *